US008413270B2

(12) United States Patent
Turner et al.

(10) Patent No.: US 8,413,270 B2
(45) Date of Patent: Apr. 9, 2013

(54) SIDERAIL ASSEMBLY FOR PATIENT SUPPORT APPARATUS

(75) Inventors: Jonathan D. Turner, Dillsboro, IN (US); Richard H. Heimbrock, Cincinnati, OH (US)

(73) Assignee: Hill-Rom Services, Inc., Batesville, IN (US)

( * ) Notice: Subject to any disclaimer, the term of this patent is extended or adjusted under 35 U.S.C. 154(b) by 120 days.

(21) Appl. No.: 12/938,744

(22) Filed: Nov. 3, 2010

(65) Prior Publication Data

US 2012/0102643 A1 May 3, 2012

(51) Int. Cl.
*A47C 21/08* (2006.01)

(52) U.S. Cl. ..... 5/430; 5/429; 5/428; 5/425

(58) Field of Classification Search ..... 5/430, 429, 5/428, 425, 424, 100, 662
See application file for complete search history.

(56) References Cited

U.S. PATENT DOCUMENTS

| | | | | |
|---|---|---|---|---|
| 421,656 | A | 2/1890 | Blanken | |
| 1,778,698 | A | 10/1930 | Walter | |
| 2,585,660 | A | 2/1952 | Kjos et al. | |
| 2,722,017 | A | 11/1955 | Burst et al. | |
| 2,817,854 | A | 12/1957 | Pratt | |
| 2,817,855 | A | 12/1957 | Pratt | |
| 3,021,534 | A | 2/1962 | Hausted | |
| 3,048,857 | A * | 8/1962 | Hutt | 5/429 |
| 3,055,020 | A | 9/1962 | Mann | |
| 3,179,957 | A | 4/1965 | Norton | |
| 3,220,024 | A | 11/1965 | Nelson | |
| 3,249,387 | A | 5/1966 | Pivacek | |
| 3,286,283 | A | 11/1966 | Bertoldo | |
| 3,290,701 | A * | 12/1966 | Luff | 5/426 |
| 3,312,986 | A | 4/1967 | Fahrni et al. | |
| 3,318,596 | A | 5/1967 | Herzog | |
| 3,344,445 | A | 10/1967 | Crawford | |
| 3,351,962 | A | 11/1967 | Dodrill et al. | |
| 3,486,176 | A | 12/1969 | Murcott | |
| 3,585,659 | A | 6/1971 | Burst et al. | |
| 3,614,795 | A * | 10/1971 | Agnew | 5/429 |
| 3,747,133 | A | 7/1973 | Hutt | |
| 3,865,434 | A | 2/1975 | Sully | |
| 3,932,903 | A | 1/1976 | Adams et al. | |
| 3,971,083 | A | 7/1976 | Peterson | |
| 4,002,330 | A | 1/1977 | Johansson | |

(Continued)

FOREIGN PATENT DOCUMENTS

| | | |
|---|---|---|
| EP | 1693037 | 8/2006 |
| EP | 1816994 | 5/2011 |

(Continued)

OTHER PUBLICATIONS

English Abstract for DE 102006011852 (B3) 1 page, Jun. 6, 2007.

*Primary Examiner* — Robert G Santos
(74) *Attorney, Agent, or Firm* — Barnes & Thornburg LLP

(57) ABSTRACT

A siderail assembly includes a guide, a support frame coupled to the frame and movable between first and second positions, and a barrier coupled to the support frame and movable therewith. The siderail assembly further includes a handle coupled to the barrier to move between a first position and a second position relative to the barrier. The siderail assembly may include electronic controls to change the position or limit movement of various portions of a patient support apparatus on which the siderail assembly may be coupled.

24 Claims, 6 Drawing Sheets

U.S. PATENT DOCUMENTS 4,120,530 A 10/1978 Imbro
4,221,370 A 9/1980 Redwine
4,277,100 A 7/1981 Beougher
4,332,042 A * 6/1982 Koncelik ..... 5/424
4,417,361 A 11/1983 Smith
4,426,071 A 1/1984 Klevstad
4,439,880 A 4/1984 Koncelik et al.
4,541,622 A 9/1985 Tabuchi
4,612,679 A 9/1986 Mitchell
4,626,016 A 12/1986 Bergsten
4,680,790 A 7/1987 Packard et al.
4,703,975 A 11/1987 Roberts et al.
4,715,592 A 12/1987 Lewis
4,747,171 A 5/1988 Einsele et al.
4,839,933 A 6/1989 Plewright et al.
4,932,090 A 6/1990 Johansson
4,959,878 A 10/1990 Essek
4,993,089 A 2/1991 Solomon et al.
5,038,430 A 8/1991 Bly
5,060,327 A 10/1991 Celestina et al.
5,069,465 A 12/1991 Stryker et al.
5,083,430 A 1/1992 Hirata et al.
5,084,925 A 2/1992 Cook
5,195,200 A 3/1993 Leoutsakos
D336,578 S 6/1993 Celestina
5,216,768 A 6/1993 Bodine et al.
5,225,403 A 7/1993 Treiber et al.
5,231,721 A 8/1993 Fish
5,255,403 A 10/1993 Ortiz
5,335,385 A 8/1994 Brown
5,337,430 A 8/1994 Schlein
5,347,682 A 9/1994 Edgerton, Jr.
5,381,571 A 1/1995 Gabhart
5,384,927 A 1/1995 Mardero et al.
5,388,294 A 2/1995 Reeder
5,394,581 A 3/1995 Leoutsakos
5,418,988 A 5/1995 Iura
5,433,235 A 7/1995 Miric et al.
5,463,784 A 11/1995 Alpern
5,471,689 A 12/1995 Shaw et al.
5,485,699 A 1/1996 Gabhart
5,542,136 A 8/1996 Tappel
5,542,138 A 8/1996 Williams et al.
5,586,352 A 12/1996 O'Brien et al.
5,640,726 A * 6/1997 Fichner-Rathus ..... 5/426
5,678,267 A 10/1997 Kinder
5,689,839 A 11/1997 Laganiere et al.
5,781,945 A 7/1998 Scherer et al.
5,787,530 A 8/1998 Brix
5,802,636 A 9/1998 Corbin et al.
5,806,111 A 9/1998 Heimbrock et al.
5,832,549 A 11/1998 Le Pallec et al.
5,836,026 A 11/1998 Reed
5,878,452 A 3/1999 Brooke et al.
6,058,531 A 5/2000 Carroll
6,076,209 A 6/2000 Paul
6,101,678 A 8/2000 Malloy et al.
6,185,767 B1 2/2001 Brooke et al.
6,240,583 B1 6/2001 Brooke et al.
D458,481 S 6/2002 Brooke
D459,119 S 6/2002 Brooke
6,397,416 B2 6/2002 Brooke et al.
6,401,280 B1 * 6/2002 Baker ..... 5/662
6,427,264 B1 8/2002 Metz et al.
6,668,402 B2 12/2003 Heimbrock
6,675,418 B1 1/2004 Armstrong
6,691,350 B2 2/2004 Weismiller
6,728,985 B2 5/2004 Brooke et al.
6,789,280 B1 9/2004 Paul
6,829,793 B2 12/2004 Brooke et al.
6,860,281 B1 3/2005 Clift
6,961,972 B2 11/2005 Pendell
7,020,920 B2 4/2006 Armstrong
7,032,265 B2 4/2006 Miller
7,039,971 B2 5/2006 Sebastien
7,150,058 B2 * 12/2006 Rabska et al. ..... 5/662
D535,544 S 1/2007 DeBraal et al.
7,234,182 B2 6/2007 Miller et al.
7,412,734 B2 * 8/2008 Stryker et al. ..... 5/430
7,472,445 B2 1/2009 Miller
7,536,738 B2 5/2009 Richards et al.
7,568,249 B1 8/2009 Kunde et al.
7,712,167 B2 * 5/2010 Guguin et al. ..... 5/430
7,805,782 B2 * 10/2010 Hakamiun et al. ..... 5/430
7,805,789 B1 10/2010 Dean
7,814,588 B2 * 10/2010 Guguin et al. ..... 5/430
7,971,291 B2 * 7/2011 Stryker et al. ..... 5/430
2001/0027578 A1 10/2001 Brooke et al.
2002/0078502 A1 * 6/2002 Baker ..... 5/429
2002/0095728 A1 7/2002 Weismiller
2003/0024048 A1 2/2003 Heimbrock
2003/0056293 A1 3/2003 Brooke et al.
2003/0167568 A1 9/2003 Brooke
2004/0168254 A1 * 9/2004 Rabska et al. ..... 5/662
2005/0120485 A1 6/2005 Sebastien
2006/0085914 A1 4/2006 Peterson et al.
2006/0090260 A1 * 5/2006 Stryker et al. ..... 5/430
2006/0130238 A1 6/2006 Smith
2006/0130239 A1 6/2006 Smith
2006/0195984 A1 * 9/2006 HakamiuN et al. ..... 5/430
2007/0151032 A1 7/2007 Heavrin
2009/0007332 A1 1/2009 Wu et al.
2009/0007333 A1 * 1/2009 Guguin et al. ..... 5/428
2009/0007334 A1 * 1/2009 Stryker et al. ..... 5/430
2009/0229049 A1 * 9/2009 Heimbrock et al. ..... 5/425
2010/0242176 A1 9/2010 Newkirk et al.
2011/0185507 A1 8/2011 Abernathey et al.
2012/0023665 A1 * 2/2012 Heimbrock ..... 5/425
2012/0023666 A1 * 2/2012 Heimbrock et al. ..... 5/428
2012/0054961 A1 * 3/2012 Heimbrock et al. ..... 5/430
2012/0084922 A1 * 4/2012 Turner ..... 5/618
2012/0102643 A1 * 5/2012 Turner et al. ..... 5/430
2012/0110735 A1 * 5/2012 Andrienko et al. ..... 5/430

FOREIGN PATENT DOCUMENTS

WO WO 82/02832 9/1982
WO WO 01/47340 7/2001
WO WO 03/015686 2/2003
WO WO 03/032777 4/2003
WO WO 2006025245 3/2006
WO WO 2006/058506 6/2006

* cited by examiner

SIDERAIL ASSEMBLY FOR PATIENT SUPPORT APPARATUS

BACKGROUND

The present disclosure is related to a support apparatus for supporting a patient. More particularly, the present disclosure relates to a bed that can be manipulated to achieve both a conventional bed position having a horizontal support surface and a chair position having the feet of the patient on or adjacent to the floor and the head and back of the patient supported above a seat formed by the bed.

It is known to provide beds that have a head siderail assembly coupled to a head portion of the support surface and a foot siderail assembly coupled to a seat portion of the support surface. The siderail assemblies may be movable independently of one another between a raised position and a lowered position. The siderail assemblies may be used in the raised position to retain patients resting on the support surface and in the lowered position to transfer patients from the bed to another support apparatus, allow a caregiver improved access to the patient, or to help with entering and exiting the bed.

It is also known that patients egress from a side of the bed. Before the patient is able to egress, the patient must rotate the patient's body on the support surface to face toward the side, swing the patient's legs over the side of the bed, and remain sitting in an upright position without support from the support surface to the patient's back. Such coordinated movement to egress from the side of the bed may be difficult for some patients. As a result, egress from the chair position of the bed may be more suitable to some patients. With the bed in the chair position, the patient begins with the patient's feet resting on the floor, the patient sitting in the upright position, and the patient's back being supported by the support surface. To egress from the bed, the patient supports a portion of the patient's weight on the support surface on each side of the patient or on a caregiver standing next to the bed. The patient then leans forward and transfers the remaining weight to the patient's feet.

SUMMARY

The present application discloses one or more of the features recited in the appended claims and/or the following features which, alone or in any combination, may comprise patentable subject matter.

According to one aspect of the present disclosure, a siderail assembly for a patient support apparatus includes a guide, a support, a barrier, and an egress unit. The guide mounts to a frame of the patient support apparatus and the support is coupled to the guide to move relative to the guide. The barrier is coupled to the support to pivot about a generally horizontal axis between a raised position and a lowered position. The barrier includes an outward side that faces away from a patient support apparatus and an inward side that faces toward a deck included in a patient support apparatus. The egress unit is coupled to the barrier to move relative to the barrier between a barrier position and an egress position. When the egress unit is in the barrier position, the egress unit lies in a generally vertical plane adjacent to the barrier. When the egress unit is in the egress position, the egress unit is spaced-apart from barrier and a portion of the egress unit extends away from the inward side of the barrier.

In some embodiments, the egress unit includes a handle and a slide assembly. The slide assembly may be arranged to lie between and to interconnect the handle to the barrier. The slide assembly may be movable between a retracted position in which the handle is adjacent the barrier and an extended position in which the handle has slid away from the barrier in a longitudinal direction.

The handle and the barrier may cooperate to define a first barrier length when the slide assembly is in the retracted position. The handle and the barrier may cooperate to define a second barrier length when the slide assembly is in the extended position. The first barrier length may be less than the second barrier length.

In some embodiments, the handle is coupled to the slide assembly to move about a pivot axis between a first position and a second position. When the handle is in the first position, the handle may extend away from the slide assembly in a longitudinal direction and lie in a generally vertical first plane. When the handle is in the second position, the handle may extend away from the slide assembly in a lateral direction and lie in a generally vertical second plane. The pivot axis may intersect the generally horizontal axis at about a right angle. The lateral direction may be orthogonal to the longitudinal direction and the second plane may be orthogonal to the first plane.

The egress unit may further comprise an egress position controller. The egress position controller may be configured to selectively block movement of the egress unit between the barrier position and the egress position. In some embodiments, the egress position controller includes a handle lock and a slide lock. The handle lock may be coupled to the to the slide assembly to move therewith and may be configured to selectively block movement of the handle relative to the slide assembly. The slide lock may be coupled to the barrier to selectively block movement of the handle relative to the barrier.

The handle lock may include a plunger, a receiver, and a bias spring. The plunger may be coupled to the slide assembly to move relative to the slide assembly. The receiver may be formed in the handle and may be configured to mate with the plunger when the handle lock is in a locked position. The bias spring may interconnect the plunger and the slide assembly and may be configured to provide a bias force to the plunger to urge the plunger to mate with the receiver.

In some embodiments, the slide lock includes a piston, a notch, and a bias spring. The piston may be coupled to the barrier to move relative to the barrier. The notch may be formed in the slide assembly and may be configured to mate with the plunger when the slide lock is in a locked position. The bias spring may interconnect the piston and the barrier and may be configured to provide a bias force to the piston to urge the piston to mate with the notch.

In some embodiments, the handle is coupled to the slide assembly to move about a pivot axis between a first position and a second position. When the handle is in the first position, the handle may lie in a recess formed in the barrier. When the handle is in the second position, the handle may extend away from the inner side of the barrier and may lies in a generally horizontal plane. The horizontally plane may be generally orthogonal to both the inner and outer sides of the barrier. In some embodiments, the pivot axis may be spaced-apart above and generally parallel to generally horizontal axis.

In another aspect of the present disclosure, a siderail assembly for a patient support apparatus includes a linkage, a barrier, and an egress unit. The linkage mounts to a side of a patient support apparatus and the side extends between a foot end and a head end of the patient support apparatus. The barrier is movable between a raised position and lowered position. The barrier includes a foot edge arranged to face the foot end and a spaced-apart head edge arranged to face toward the head end. The barrier also includes an inner side, an outer side, a first portion, a second portion, and a third portion. The inner side faces toward a mattress included in the patient support apparatus and the outer side faces away from the mattress. The first portion is coupled to the linkage and is arranged to extend between the head and the foot edges. The second portion is appended to the first portion, extends between the head and foot edges, and extends in an upward direction. The third portion is appended to the second portion and may extend in the upward direction away from the second portion. The egress unit includes a handle and a slide assembly that is arranged to lie between the barrier and the handle. The slide assembly interconnects the handle to the barrier and is movable between a retracted position and an extended position. When the slide assembly is in the retracted position, the handle lies in confronting relation with the barrier. When the slide assembly is in the extended position, the handle lies in spaced-apart relation to the barrier. The handle is movable between a first position in which the handle extends away from the barrier toward the foot end of the patient support apparatus and a second position in which the handle extends away from inner side of the barrier toward the mattress.

In some embodiments, the slide assembly is spaced-apart above the first portion of the barrier and is coupled to the third portion. The slide assembly may include a first tube and a first slide-tube receiver. The first slide-tube receiver may be coupled to the top portion of the barrier to move with the barrier. The first slide tube may be coupled to the first slide-tube receiver for translating movement back and forth relative to the slide-tube receiver. The first slide tube may be generally aligned with the pivot axis to move back and forth along the pivot axis.

The slide assembly may further include a second slide-tube and a second slide-tube receiver. The second slide tube may be spaced-apart below the first slide tube. The second slide-tube receiver may be coupled to the second portion of the barrier to move therewith and may be spaced-apart below the first slide-tube receiver.

In another aspect of the present disclosure, a siderail assembly for a patient support apparatus includes a guide, a support, a barrier, and an egress unit. The guide mounts to a frame included in a patient support apparatus. The support is coupled to the guide to move relative to the guide. The barrier is coupled to the support to move between a raised position and a lowered position while the barrier remains in a substantially vertical orientation. The barrier includes a foot edge, a head edge, an inner side, an outer side, a first portion, a second portion, and a third portion. The foot edge is arranged to face toward a foot end of the patient support apparatus. The head edge is arranged to face toward a head end of the patient support apparatus. The inner side is adapted to face toward a mattress included in the patient support apparatus and the outer side is adapted to face away from the mattress. The first portion is coupled to the linkage and is arranged to extend between the head and the foot edges. The second portion is appended to the first portion, is arranged to extend in an upward direction, and is arranged to extend between the head and foot edges. The third portion is appended to the second portion and is arranged to extend in the upward direction away from the second portion to locate the second portion between the first and third portions. The egress unit includes a handle and a slide assembly that interconnects the handle to the barrier. The slide assembly is movable from a retracted position in which the handle is in confronting relation with the barrier to an extended position in which the handle has slid away from the barrier in the longitudinal direction toward the foot end of the patient support apparatus. The handle is movable in a counter-clockwise direction about a pivot axis from a first position in which the handle is arranged to lie in a generally vertical plane to a second position in which the handle extends away the inner side of the barrier and lies in a plane. The generally vertical plane is generally parallel to the outward and inner sides of the barrier and the plane is generally orthogonal to the inner and outer sides of the barrier.

In some embodiments, the siderail assembly further includes a light that is coupled to the barrier. The light may be configured to provide light to the handle in response to a command from a bed controller. The siderail assembly may further comprise a sensor that is configured to sense a position of the handle relative to the barrier. The sensor may send an input to a bed controller to control movement of the patient support apparatus in response to the second input.

Additional features, which alone or in combination with any other feature(s), including those listed above, those listed in the claims, and those described in detail below, may comprise patentable subject matter. Other features will become apparent to those skilled in the art upon consideration of the following detailed description of illustrative embodiments exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 1:
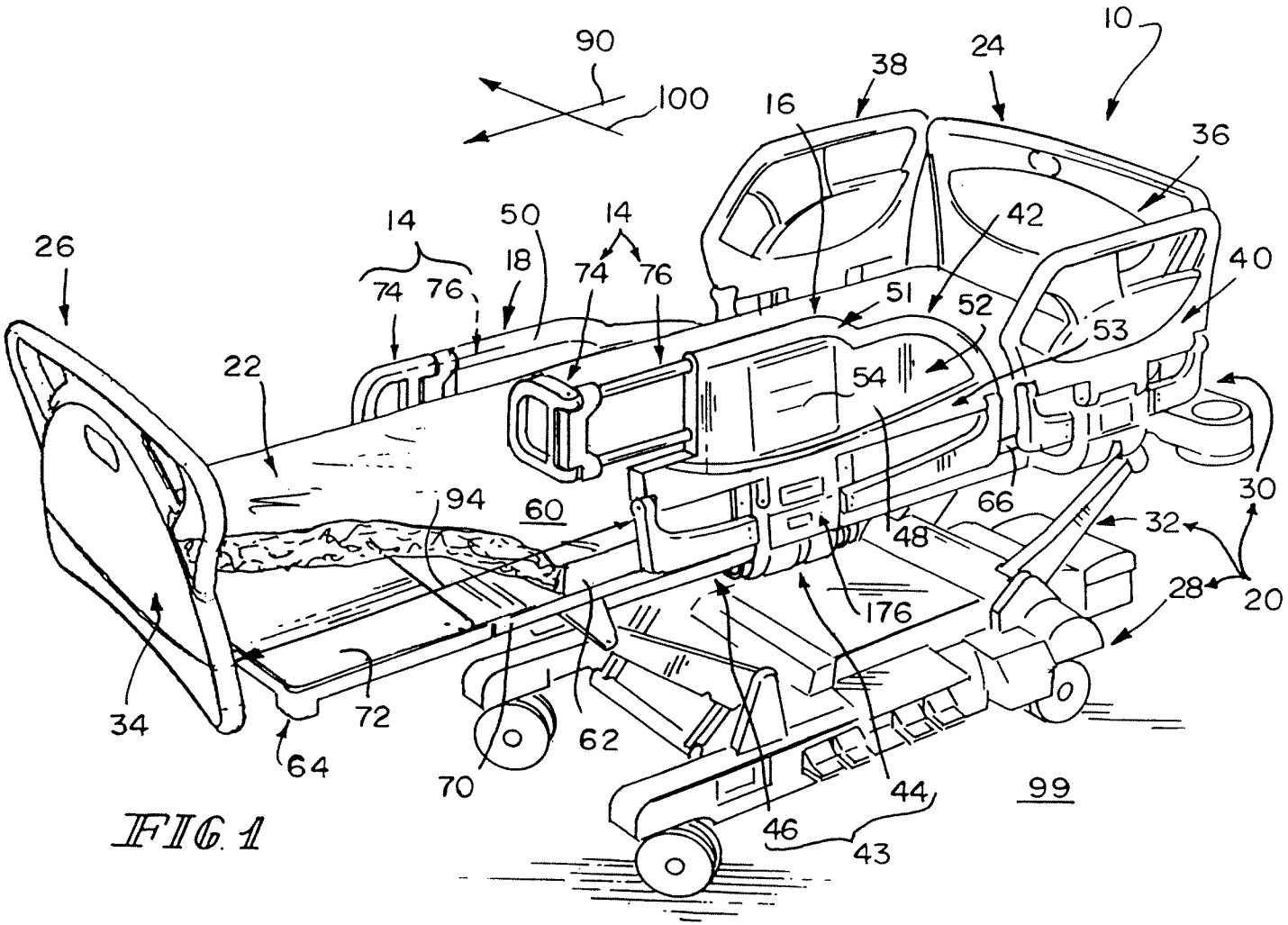
FIG. 1 is a perspective view of a patient support apparatus in a generally flat configuration and having three siderails in a raised position and one siderail in the lowered position.
Figure 2:
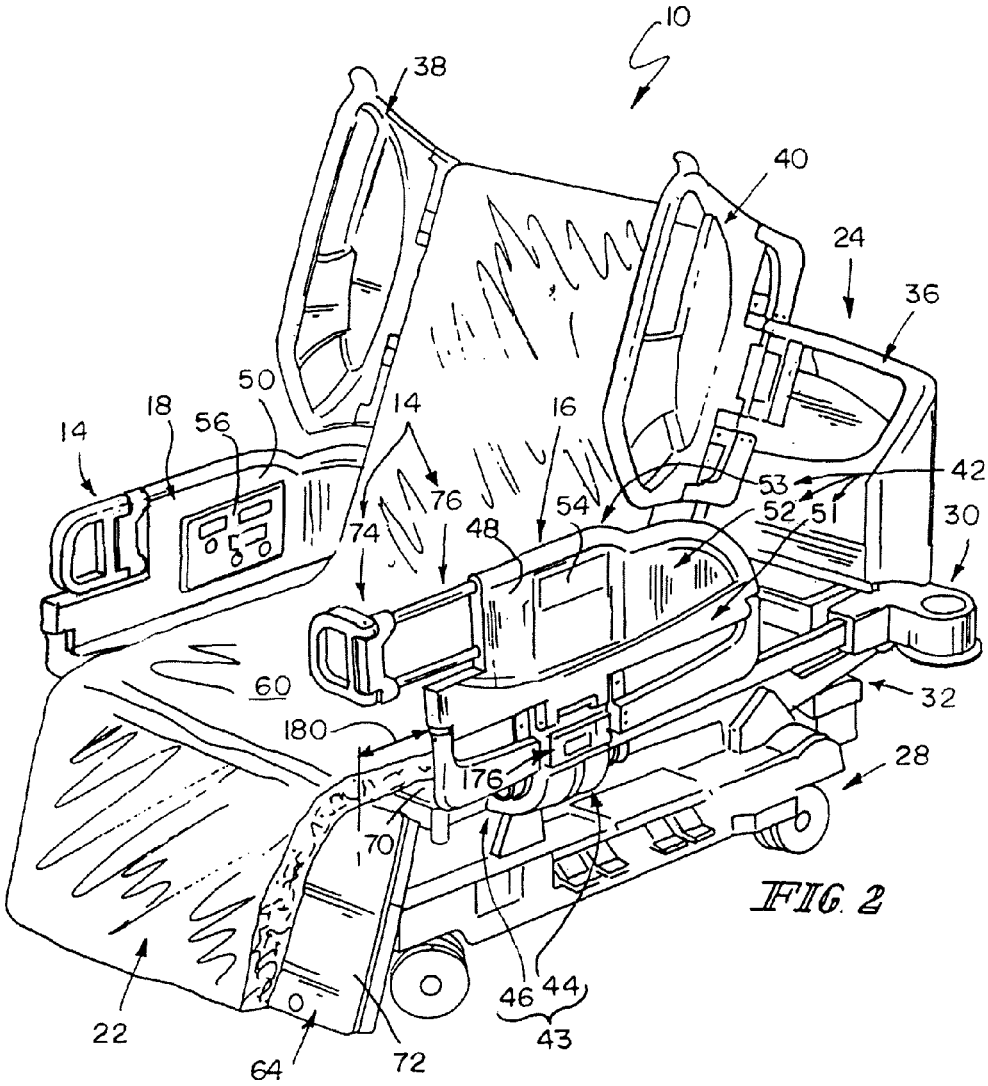
FIG. 2 is a perspective view of the patient support apparatus of FIG. 1 moved to a chair-egress position.

A patient support apparatus, such as a hospital bed 10 is shown, for example, in FIGS. 1 and 2. The hospital bed 10 is movable between a bed position, as shown in FIG. 1, and a chair-egress position as shown in FIG. 2. The hospital bed 10, when in the bed position, provides support to a patient (not shown) such that the patient's feet are supported spaced-apart from the ground 99. The hospital bed 10, when in the chair-egress position, provides support to a patient such that the patient sits upright and the patient's feet are positioned on the ground 99. The chair-egress position is also used by patients and caregivers to help patients egress or exit the hospital bed 10. An egress unit 14 included in the foot siderail assemblies 16, 18 includes a slide assembly 76 that is movable between a retracted position, shown in FIG. 3, and an extended position, shown in FIGS. 1, 2, 4, and 5, and a egress handle 74 that movable between a first position, shown in FIG. 3, and a second position shown in FIGS. 1, 2, 4, and 5. When the handle 74 is in the second position and the slide assembly 76 is in the extended position, a patient may support a portion of his or her weight on the egress units during egress from the hospital bed 10.

The hospital bed 10 includes a frame 20 and a mattress 22 that is supported by the frame 20 as shown in FIGS. 1 and 2. The hospital bed 10 has a head end 24 and a foot end 26. The frame 20 includes a base 28 and an upper frame 30 coupled to the base 28 by an elevation system 32. The elevation system 32 is operable to raise, lower, and tilt the upper frame 30 relative to the base 28. The hospital bed 10 further includes a foot panel 34 positioned adjacent the foot end 26 and a head panel 36 positioned adjacent the head end 24. The foot panel 34 is removable and is removed prior to moving the hospital bed 10 into the chair-egress position shown in FIG. 2.

The mattress 22 of hospital bed 10 includes a top surface 60, a bottom surface (not shown), and a perimeter surface 62 as shown in FIGS. 1 and 2. The upper frame 30 of the frame 20 supports deck 64 with the mattress 22 supported on the deck 64. The deck 64, as shown in FIG. 1, includes a head section 66, a seat section 68, a thigh section 70, and a foot section 72. The head section 66 pivotably raises and lowers relative to the thigh section 70. Additionally, the thigh section 70 pivotably raises and lowers relative to the seat section 68. Also, the foot section 72 is extendable and retractable to change an overall length of the foot section 72, and therefore, to change an overall length of the deck 64.

In some embodiments, the seat section 68 also moves, such as by translating on the upper frame 30, as the hospital bed 10 moves between the bed position and the chair-egress position. In those embodiments where the seat section 68 translates along the upper frame 30, the thigh and foot sections 70, 72 also translate along with the seat section 68. As the hospital bed 10 moves from the bed position to the chair-egress position, the foot section 72 lowers relative to the thigh section 70 and shortens in length. As the hospital bed 10 moves from the chair-egress position to the bed position, the foot section 72 raises relative to the thigh section 70 and increases in length. Thus, in the chair-egress position, the head section 66 extends generally vertically upwardly from the upper frame 30 and the foot section 72 extends generally downwardly from the thigh section 70 as shown in FIG. 2.

The hospital bed 10 also includes four siderail assemblies coupled to the upper frame 30: a patient-right head siderail assembly 38, the patient-right foot siderail assembly 18, a patient-left head siderail assembly 40, and a patient-left foot siderail assembly 16. Each of the siderail assemblies 16, 18, 38, and 40 is movable between a raised position, as the left foot siderail assembly 16 is shown in FIG. 1, and a lowered position, as the right foot siderail assembly 18 is shown in FIG. 1. Siderail assemblies 16, 18, 38, and 40 are sometimes referred to as siderails 16, 18, 38, 40 herein.

The left foot siderail 16 is similar to the right foot siderail 18, and thus, the following discussion of the left foot siderail 16 is equally applicable to the right foot siderail 18. The left foot siderail 16 includes a barrier panel 42 and a linkage 43 that includes a support assembly 44 and a guide assembly 46. The guide assembly 46 is coupled to the upper frame 30 in a fixed position and is configured to guide the support assembly 44 and the barrier panel 42 during movement of the foot siderail 16 between the raised and the lowered positions. The support assembly 44 interconnects the barrier panel 42 and the guide assembly 46 to cause the barrier panel 42 to remain in a substantially vertical orientation during movement between the raised and the lowered positions.

The barrier panel 42 includes an outward side 48 and an oppositely facing inward side 50. As shown in FIGS. 1 and 2, inward side 50 faces toward the mattress 22 and the outward side 48 faces away from the mattress 22. A first user interface 54 is coupled to the outward side 48 of the barrier panel 42 for use by a caregiver (not shown). As shown in FIG. 2, a second user interface 56 is coupled to the inward side 50 for use by a patient (not shown). Both the first and second user interfaces 54, 56 are coupled electrically to a bed controller 58 included in the hospital bed 10. The user interfaces 54, 56 allow caregivers and patients to control movement of the elevation system 32 as well as other features of the hospital bed 10.

The barrier panel 42 further includes a first portion 51, a second portion 52, and a third portion 53 with the second portion 52 positioned between the first and the third portions 51, 53 as shown in FIGS. 1-5. Illustratively, first portion 51 is also called bottom portion 51, second portion 52 is also called medial portion 52, and third portion 53 is also called top portion 53. The bottom portion 51 is coupled to the support assembly 44 and extends upwardly. The medial portion 52 is appended to the bottom portion 51 and extends upwardly away from the bottom portion 51. The top portion 53 is appended to the medial portion 52 and is arranged to extend upwardly.

Figure 3:
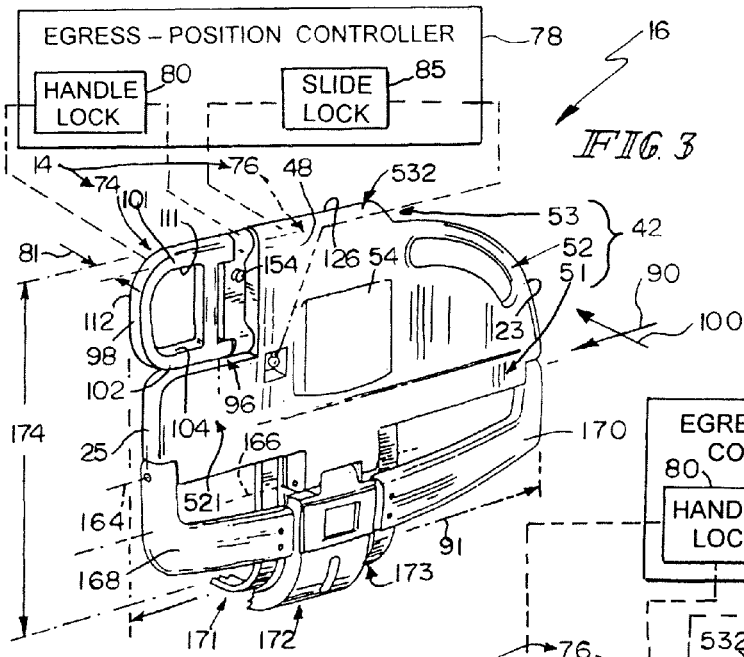
FIG. 3 is an enlarged partial perspective view of the patient-left foot siderail of FIGS. 1 and 2 with a slide assembly in a retracted position and an egress handle in a first position.
Figure 4:
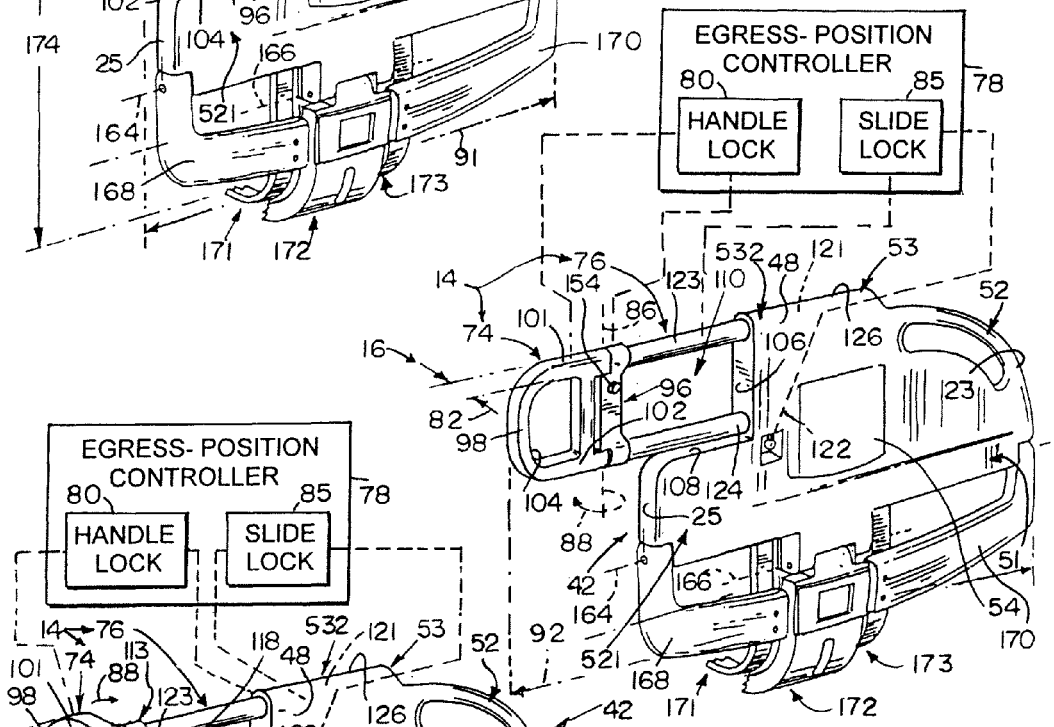
FIG. 4 is a view similar to FIG. 3 with the slide assembly in an extended position and the handle in the first position.
Figure 5:
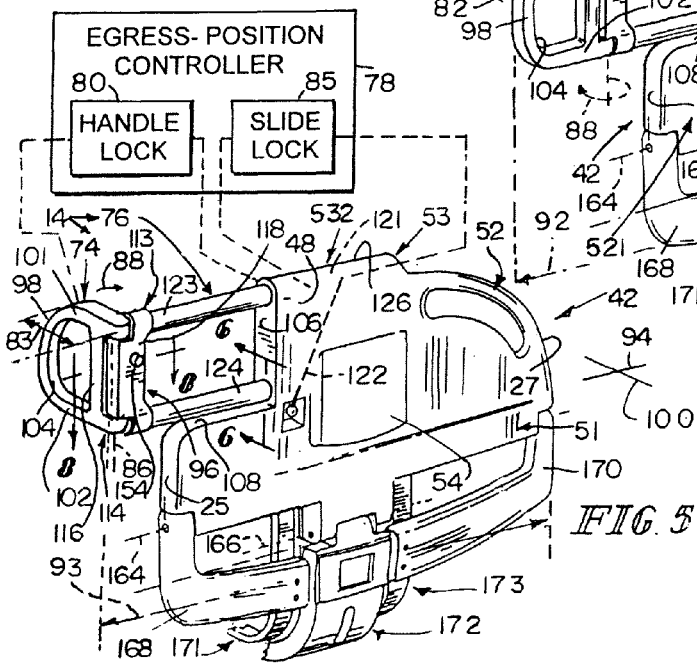
FIG. 5 is a view similar to FIG. 4 with the slide assembly in the extended position and the egress handle in a second position.

The left foot siderail 16 further includes an egress unit 14 as shown in FIGS. 1-5. The egress unit 14 includes a handle 74, a slide assembly 76, and an egress position controller 78 as shown in FIGS. 3-5. The slide assembly 76 interconnects the handle 74 to the barrier panel 42 for selective sliding movement of the handle 74 relative to the barrier panel 42. A caregiver uses the egress position controller 78 to retain the slide assembly 76 in the retracted position of FIG. 3, the extended position of FIGS. 4 and 5, or any of a number of positions therebetween, and the egress handle 74 in the first position of FIGS. 3 and 4, the second position of FIG. 5, or any of a number of positions therebetween.

A caregiver uses the handle 74 and the slide assembly 76 by disengaging the egress position controller 78 as suggested in FIGS. 3-5. The egress position controller 78 includes a handle lock 80 and a slide lock 85. The handle lock 80 is used to block movement of the handle 74 relative to the slide assembly 76. The slide lock 85 is used to block movement of the handle 74 relative to the barrier panel 42. To re-arrange the egress unit 14, a caregiver first moves the slide lock 85 from the locked position in which movement of the slide assembly 76 is blocked to the unlocked position in which the slide assembly 76 is permitted to move from a retracted position in which the handle 74 is adjacent the barrier panel 42 to an extended position in which the handle 74 is spaced-apart from the barrier panel 42 as shown in FIG. 4. After the slide assembly 76 is in the extended position, the caregiver re-engages the slide lock 85. Next, the caregiver moves the handle lock 80 from a locked position in which rotation of the handle 74 is blocked to the unlocked position in which the handle 74 is permitted to rotate relative to the slide assembly 76 from a first position generally aligned with the slide assembly 74 to a second position extending away from and perpendicular to the inward side 50 of the barrier panel 42 as suggested in FIG.

5. Finally, the caregiver re-engages the handle lock 80 so that unintended movement of the handle 74 is blocked.

As shown in FIG. 3, the slide assembly 76 begins in the retracted position and the handle 74 begins in the first position. The slide assembly 76, when in the retracted position, causes the handle 74 to lie in confronting relation to the top portion 53 of the barrier panel 42. As shown in FIG. 3, the handle also lies between a head edge 23 and an oppositely spaced-apart foot edge 25 of the barrier panel 42. The handle 74 lies in generally coplanar relation with the barrier panel 42 and does not interfere with the movement of the siderail 16 between the raised and the lowered positions. The slide assembly 76 may be in retracted position when the hospital bed 10 is in either the bed position or the chair-egress position.

The slide assembly 76 moves from the retracted position to the extended position by translating the handle 74 away from the barrier panel 42 in a longitudinal direction 90 so that the handle 74 is spaced-apart from the barrier panel 42 as shown in FIG. 4. The slide assembly 76 supports the handle 74 and between the extended and retracted positions. The extended position of the slide assembly 76 may be any of a number of intermediary positions that the handle 74 is in while the slide assembly 76 moves away from the retracted position of FIG. 3. The extended position of the slide assembly 76 also minimizes a gap 94 formed between the foot panel 34 and the foot end 26 of the barrier panel 42 as suggested in FIG. 1.

The handle 74 is movable between the first position and the second position as shown in FIGS. 4 and 5. In the first position of FIG. 3, the handle 74 extends in the longitudinal direction 90 toward the foot end 26 of the hospital bed 10. The handle 74 also lies between a middle section 532 included in the top portion 53 of the barrier panel 42 and the foot edge 25 of the barrier panel 42. The handle 74 cantilevers over a foot section 521 of the medial portion 52 and lies between a first plane defined by the outward side 48 and a second plane defined by the inward side 50. When the slide assembly 76 is in the extended position and the handle 74 is in the first position, the handle 74 extends away from the slide assembly 76 toward the foot end 26 and remains between the first and second planes.

As discussed above, the handle 74 may be moved from the first position to the second position when the slide assembly 76 is either in the retracted position or the extended position. The handle 74 moves from the first position to the second position by rotating about a handle-pivot axis 86 in a counterclockwise direction 88 about 90 degrees as suggested in FIG. 4 and shown in FIG. 5. Both handles 74 of left and right foot siderails 16, 18 extend toward one another to cause a distance between the siderails 16, 18 to be minimized so that a patient is able to grip comfortably the handles 74 and support a portion of the patient's weight during egress from the hospital bed 10. The handle 74 extends away from the inward side 50 of the barrier panel 42.

The handle 74, the slide assembly 76, and the barrier panel 42 cooperate together to define various widths and lengths of the siderail 16. When the slide assembly 76 is in the retracted position and the handle 74 is in the second position, the handle 74 cooperates with the barrier panel 42 to define a first barrier width 81 and a first barrier length 91 as shown in FIG. 3. In another example, when the slide assembly 76 is in the extended position and the handle 74 is in the first position, the handle 74 cooperates with the barrier panel 42 to define a second barrier width 82 and a second barrier length 92 as shown in FIG. 4. The second barrier width 82 is about equal to the first barrier width 81. The second barrier length 92 is greater than the first barrier length 91. In yet another example, when the slide assembly 76 is in the extended position and the handle 74 is in the second position, the handle 74 cooperates with the barrier panel 42 to define a third barrier width 83 and a third barrier length 93 as shown in FIG. 5. The third barrier width is greater than the first and second barrier widths 81, 82. The third barrier length 93 is less than the second barrier length 92, but greater than the first barrier length 91.

The handle 74, as shown in FIG. 3, includes a first side 111, an oppositely facing second side 112, a handle mount 96, a forward grip 98, a first lateral grip 101, and a second lateral grip 102. The handle mount 96 interconnects the forward grip 98 and the lateral grips 101, 102 to the slide assembly 76 as shown in FIG. 3. The first lateral grip 101 is coupled to a first end of the handle mount 96 and is arranged to extend away from the handle mount 96. The second lateral grip 102 is spaced-apart above and parallel to the first lateral grip 101 and coupled to the handle mount 96 to extend away the handle mount 96. The forward grip 98 is coupled to the first and second lateral grips 101, 102 and arranged to extend therebetween, spaced-apart from, and parallel to the handle mount 96 as shown in FIG. 3. The handle mount 96, the forward grip 98, and the lateral grips 101, 102 cooperate to define a hand aperture 104 that is configured to receive a patient's hand therein during use of the handle 74.

When the handle 74 is in the first position, the first side 111 of the handle 74 is arranged to lie in generally aligned with the outward side 48 of the barrier panel 42 and the second side 112 of the handle 74 is generally aligned with the inward side 50 of the barrier panel 42. The handle mount 96 is arranged to lie in confronting relation with a foot surface 106 of the middle section 532 included in the top portion 53 of the barrier panel 42. The foot surface 106 extends upwardly away from a top surface 108 of a foot section 521 included in the medial portion 52. As shown in FIGS. 4 and 5, the top surface 108 and the foot surface 106 intersect one another at about a right angle and cooperate to define a handle-storage space 110 in which the handle 74 lies in when the slide assembly 76 is in the retraced position and the handle 74 is in the first position.

When the handle 74 is in the second position, the first and second sides 111, 112 of the handle 74 are generally perpendicular to the outward and inward sides 48, 50 of the barrier panel 42. The handle mount 96 is spaced-apart from the foot surface 106 and remains extending upwardly relative to the top surface 108. The two lateral grips 101, 102 extend away from the handle mount 96 in a lateral direction 100. As shown in FIG. 1, the lateral direction 100 is generally perpendicular to the longitudinal direction 90. The forward grip 98 is cantilevered above the mattress 22 and ground 99 as shown in FIG. 2. When the hospital bed 10 is in the chair-egress position and the slide assembly 76 is in the extended position and the handle 74 is in the second position, the handle 74 and the foot edge 25 of the barrier panel 42 cooperate to define a distance 180. The distance 180 is sufficiently large enough to permit a patient to stand up from the hospital bed 10 and have their legs positioned between the handle 74 and the top surface 60 of the mattress 22 as suggested in FIG. 2.

The handle mount 96 includes a first pivot joint 113, a second pivot joint 114, and a handle bar 116, and a mount housing 118 as shown in FIG. 5. The mount housing 118 is coupled to the slide assembly 76 to move therewith. The first pivot joint 113 interconnects the top ends of the handle bar 116 and the mount housing 118. The second pivot joint 114 interconnects the bottom ends of the handle bar 116 and the mount housing 118. The handle bar 116 is configured to move about the handle-pivot axis 86 relative to the mount housing 118. As shown in FIG. 5, the first and second pivot joints 113, 114 define the handle-pivot axis 86 which is generally vertical and perpendicular to a longitudinal axis of the hospital bed 10.

As discussed previously, the slide assembly 76 is configured to support the handle 74 for sliding movement back and forth relative to the barrier panel 42. The slide assembly 76 includes first and second slide-tube receivers 121, 122 and first and second slide tubes 123, 124 as shown in FIGS. 4 and 5. The slide-tube receivers 121, 122 are coupled to the barrier panel 42 to move therewith. The slide tubes 123, 124 are coupled to the slide-tube receivers for sliding movement back and forth in the longitudinal direction 90. The first slide-tube receiver 121 lies adjacent to a top side 126 of the top portion 53 of the barrier panel. The second slide-tube receiver 122 is spaced-apart below the first slide-tube receiver 121.

The slide-tube receivers 121, 122, as shown in FIGS. 3-5, include a space formed in the barrier panel 42 and a bearing aperture formed in the foot surface 106. The bearing aperture opens into the space and supports the slide tubes 123, 124 for sliding movement. The slide tubes 123, 124 are tubes having sufficient strength to support a portion of a patient's weight when the slide assemblies 74 are in the extended position and the patient is using the handles 74 to egress from the hospital bed 10.

The handle 74, as discussed previously, also includes the egress position controller 78 that is used to control movement of the handle 74 and the slide assembly 76. As shown diagrammatically in FIGS. 3-5, the egress position controller 78 includes the handle lock 80 and the slide lock 85. The slide lock 85 is used to block movement of the handle 74 relative to the barrier panel 42.

Figure 6:
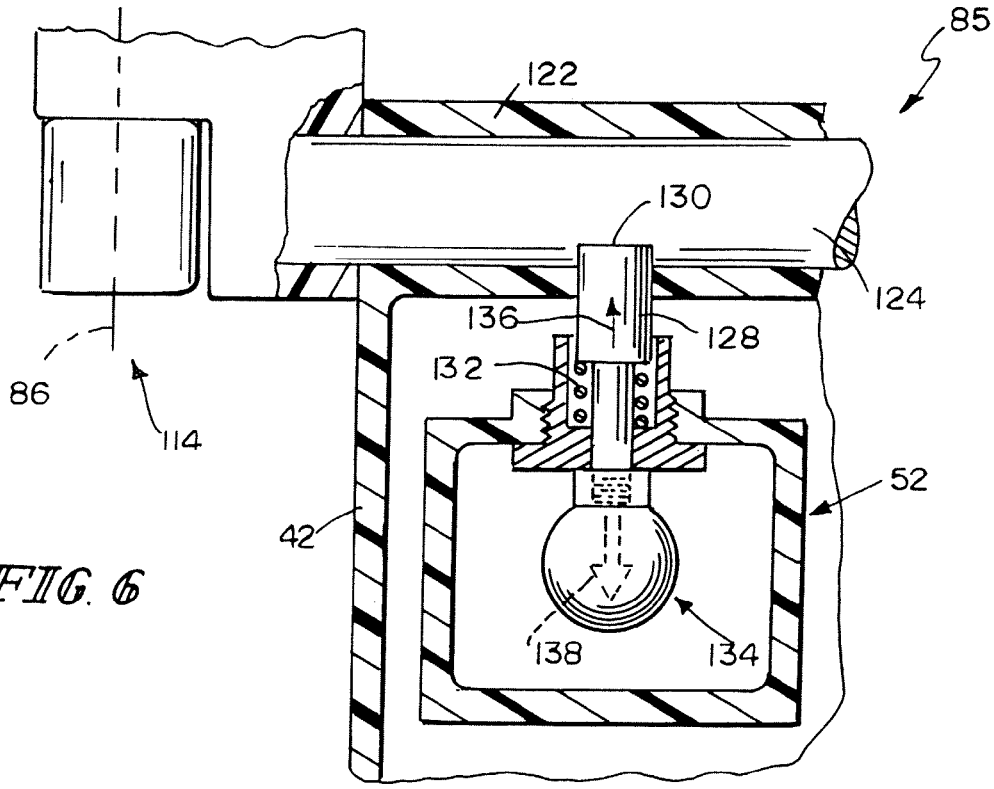
FIG. 6 is a sectional view taken along line 6-6 of FIG. 5 showing a slide-assembly lock in the locked position.
Figure 7:
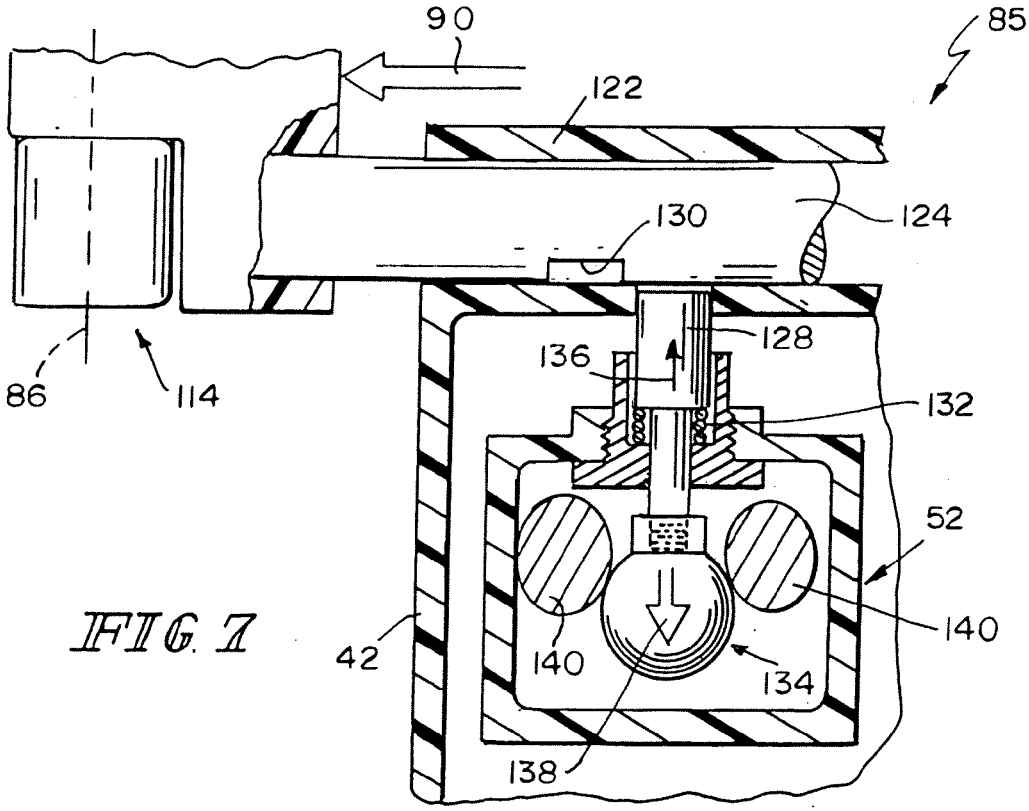
FIG. 7 is a view similar to FIG. 6 with the slide-assembly lock in the freed position.

The slide lock 85 is movable between the locked position shown in FIG. 6 in which the second slide tube 124 is blocked from moving relative to the second slide-tube receiver 122 and the unlocked position shown in FIG. 7 in which the slide tubes 123, 124 are permitted to slide relative to the slide-tube receivers 121, 122. The slide lock 85 includes a piston 128, a notch 130, a bias spring 132, and a slide-lock actuator 134. The notch 130 is formed in the slide tube 123 and configured to mate selectively with the piston 128 therein. The bias spring 132 lies between and interconnects the piston 128 and the barrier panel 42 to provide a piston-bias force 136 that urges the piston 128 to mate with the notch 130. The slide-lock actuator 134 is coupled to the piston 128 and is configured to transfer an actuation force 138 to the piston 128 to overcome the piston-bias force 136 and move the piston 128 away from the notch 130.

As shown in FIG. 6, the slide lock 85 is in the locked position in which the piston-bias force 136 has urged the piston 128 into mating contact with the notch 130. A caregiver uses the slide-lock actuator 134 to apply the actuation force 138 to the piston 128. As illustrated in FIG. 7, the caregiver 140 engages the slide-lock actuator 134 to apply the actuation force 138 in the downward direction to overcome the piston-bias force 136 and move the piston 128 out of mating contact with the notch 130 so that the slide lock 85 assumes the unlocked position. After the slide lock 85 is in the unlocked position, the caregiver slides the handle 74 away from the barrier panel 42 as shown in FIGS. 3 and 4 to cause the slide assembly 76 to assume the extended position.

Figure 8:
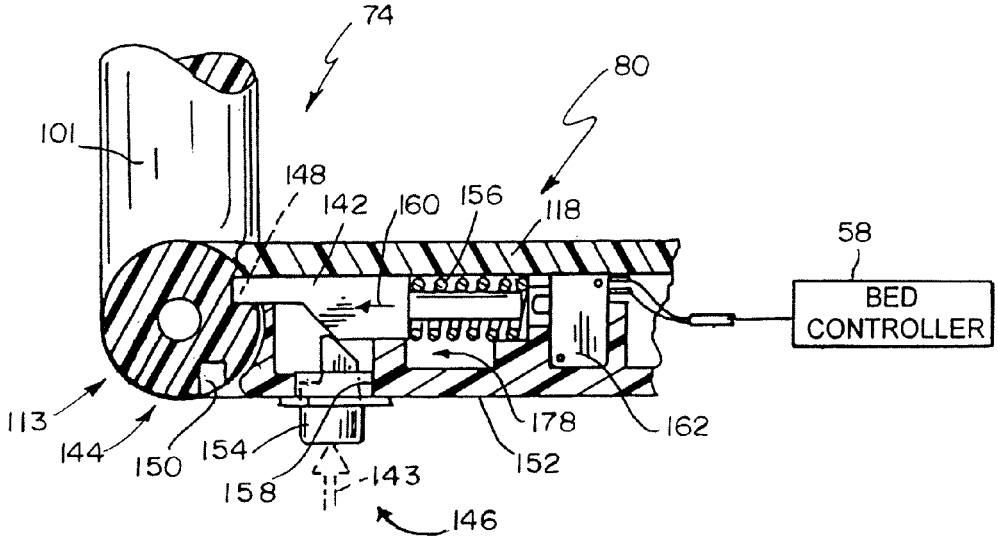
FIG. 8 is a sectional view taken along line 8-8 of FIG. 5 showing a handle lock in a locked position.
Figure 9:
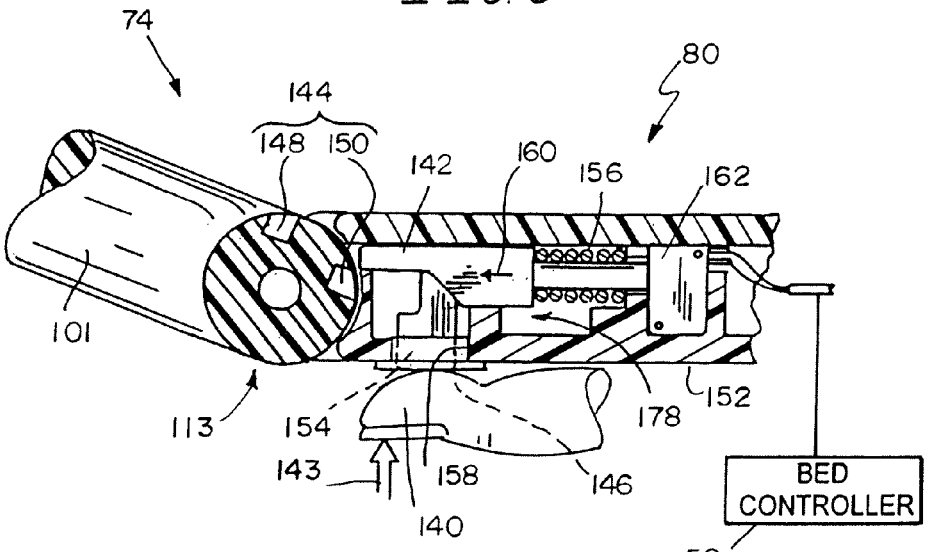
FIG. 9 is a view similar to FIG. 8 with the handle lock in the freed position.

The handle lock 80 is next moved from the locked position shown in FIG. 8 to the freed position shown in FIG. 9. The handle lock 80 blocks movement of the handle 74 relative to the slide assembly 76 when the handle lock 80 is in the locked position. The handle 74 is free to pivot about the handle-pivot axis 86 when the handle lock 80 is in the freed position. The caregiver 140 applies an actuation force 143 to the handle lock 80 to move the handle lock 80 from the locked position to the freed position as shown in FIG. 8 and shown in FIG. 9.

The handle lock 80 includes a plunger 142, a receiver 144, and a handle-lock actuator 146 as shown in FIGS. 8 and 9. The plunger 142 lies in a space 178 formed in the mount housing 118 and mates with the receiver 144 when the handle lock 80 is in the locked position and is spaced-apart from the receiver 144 when the handle lock 80 is in the freed position. As shown in FIG. 8, receiver 144 includes two slots 148 and 150 formed in the first pivot joint 113 of the handle 74. The first slot 148 is at about the two o'clock position and is associated with the handle 74 being in the second position. The second slot 150 is at about the five o'clock position and is associated with the handle 74 being in the first position. The handle-lock actuator 146 is coupled to an outer side 152 of the mount housing 118 and moves back-and-forth relative to the mount housing 118 to engage and move the plunger 142.

The handle-lock actuator 146 of handle lock 80 includes an actuator button 154 and a bias spring 156. The actuator button 154 extends through an aperture 158 formed in the mount housing 118 that opens into the space 178. The bias spring 156 is coupled to the mount housing 118 and to the plunger 142. The bias spring 156 provides a plunger-bias force 160 that urges the plunger 142 to mate with the receiver 144.

A caregiver uses the actuator button 154 to apply the actuation force 143 to the plunger 142 to overcome the plunger-bias force 160 and urge the plunger 142 away from the receiver 144. After the plunger 142 has moved away from the receiver 144, handle 74 may move between the first position and the second position. After the caregiver removes the actuation force 143, the plunger 142 mates with the receiver 144 when the handle 74 moves to either the first position or the second position.

In other embodiments, the handle lock may be a Porter Group, LLC. MECHLOK® brand locking mechanism. The locking mechanism may be either actuated by a caregiver applying a manual actuation force or the actuation force may be provided by a powered actuator included in the hospital bed 10. The powered actuator may be coupled to the bed controller and configured to respond to commands sent by the bed controller. A user may disengage the handle lock to free the handles 74 to move to the second position by using one of the user interfaces 54, 56 to send an input to the controller to cause the powered actuator to provide the actuation force to the locking mechanism.

As shown in FIGS. 8 and 9, the handle 74 further includes a position sensor 162. The position sensor 162 is coupled electronically to the bed controller 58 also included in the hospital bed 10. The position sensor 162 senses the position of the plunger 142 relative to the barrier panel 42. The position of the handle 74 is determined as a result of slots 148, 150 having different depths. For example, the first slot 148 is deeper than the second slot 150. Thus, the position sensor 162 is able to sense when the handle 74 is in the first position or the second position and when the handle lock 80 is in the locked position or the unlocked position.

Similar to handle 74, the slide assembly 76 may include a slide position sensor that is also coupled to the bed controller 58. The slide position sensor senses the position of piston 128 of the slide lock 85. The position of the piston 128 may be determined as a result of the first notch 130 having a greater depth than another spaced-apart notch that is associated with the handle 74 being in the extended position. As a result, the slide position sensor is able to sense when the slide assembly is in the retracted position or the extended position and when the slide lock 85 is in the locked position or the unlocked position.

The position sensor 162 of the handle 74 is coupled to the bed controller 58 to communicate the position of the handle 74 to the bed controller 58 as shown in FIGS. 8 and 9. Similarly, the position sensor of the slide lock 85 may also be coupled to the bed controller 58. The bed controller 58 is coupled electrically to the elevation system 32 to control vertical movement of the upper frame 30 relative to the base 28. The bed controller 58 also controls movement of the hospital bed 10 between the bed position and the chair-egress position. As a result of bed controller 58 being coupled to the position sensors, the bed controller 58 blocks movement of the elevation system 32 when the slide assembly 76 is in the extended position or the retracted position so as to minimize damage to the foot siderails 16, 18.

As discussed previously, left foot siderail 16 also includes the support assembly 44 that interconnects the barrier panel 42 to the guide assembly 46. The support assembly 44, embodied as a link mechanism, includes a first upper link 171, a second upper link 173, and a lower link 172 as shown in FIGS. 3-5. The links 171, 172, and 173 interconnect the bottom portion 51 of the barrier panel 42 to the guide assembly 46 to cause the barrier panel 42 to pivot between the raised and lowered positions. The first and second upper links 171, 173 are coupled to the barrier panel 42 to cause the barrier panel 42 to pivot about a first generally horizontal pivot axis 164. The lower link 172 interconnects the barrier panel 42 and the guide assembly 46 to cause the barrier panel 42 to pivot about a second generally horizontal pivot axis 166. When the foot siderail 16 is in the raised position, the first pivot axis 164 is spaced-apart above and parallel to the second pivot axis 166. The first and second pivot axes 164, 166 lie generally in parallel relation to a longitudinal axis of the hospital bed 10 that extends between the head end 24 and the foot end 26 of the frame 20.

The support assembly 44 further includes a pair of barrier extenders 168, 170 as shown in FIGS. 1-5. The first barrier extender 168 is coupled to the barrier panel 42 to pivot about the first pivot axis 164 and is coupled to the first upper link 171 to move therewith. The second barrier extender 170 is coupled to the barrier panel 42 to pivot about the first pivot axis 164 and is coupled to the second upper link 173 to move therewith. The barrier extenders 168 and 170 cooperate with the outward side 48 of barrier panel 42 to establish an enlarged barrier surface having a raised height 174 when the foot siderail 16 is in the raised position as shown in FIG. 3. The barrier extenders 168, 170 pivot with the first and second upper links 171, 173 under the deck 64 to reduce the height of the foot siderail 16 when foot siderail 16 is in the lowered position which is smaller than a raised height 174 of the left foot siderail 16 so that a distance defined between the deck 64 and the ground 99 is minimized. As illustrated in FIG. 5, first and second pivot joints 113, 114 cooperate to define the handle-pivot axis 86 and the handle-pivot axis 86 is spaced-apart above and parallel to the first pivot axis 164

The left foot siderail 16 also illustratively includes at least one latching mechanism 176, as shown in FIGS. 1 and 2. The latching mechanism 176 releasably secures a portion of the foot siderail assembly 16, 18 to the frame 20 of the patient support apparatus. The latching mechanism 176 may releasably secure the barrier panel 42 in one or more positions. The latching mechanism 176 secures the barrier panel 42 in the raised position to block movement of the barrier panel 42 from the raised position to the lowered position. The latching mechanism may releasably secure a barrier panel with a support assembly, releasably secure the support assembly with the frame of the patient support apparatus, and releasably secure the support assembly with the guide assembly.

Figure 10:
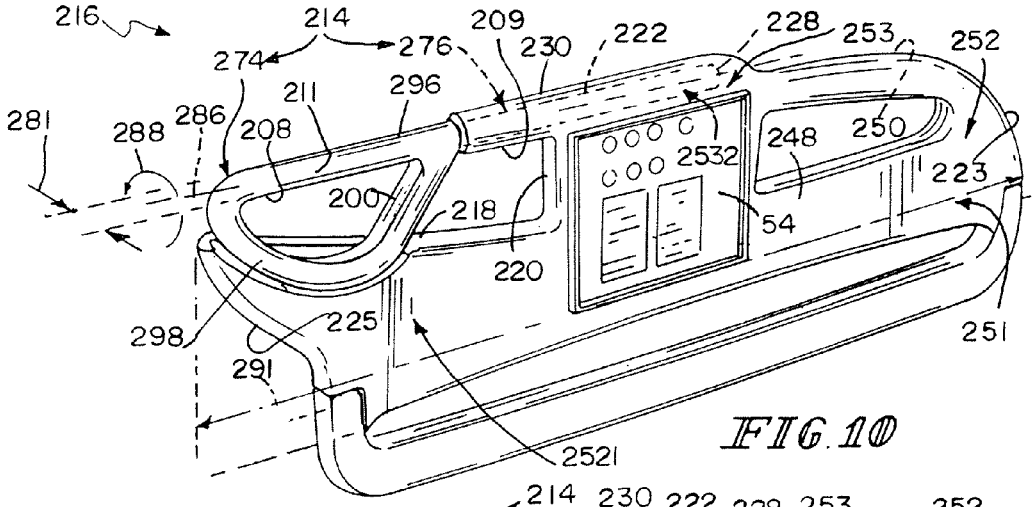
FIG. 10 is an enlarged partial perspective view of another embodiment of a left foot siderail with another embodiment of a slide mechanism in a retracted position and another embodiment of a handle in a first position.
Figure 11:
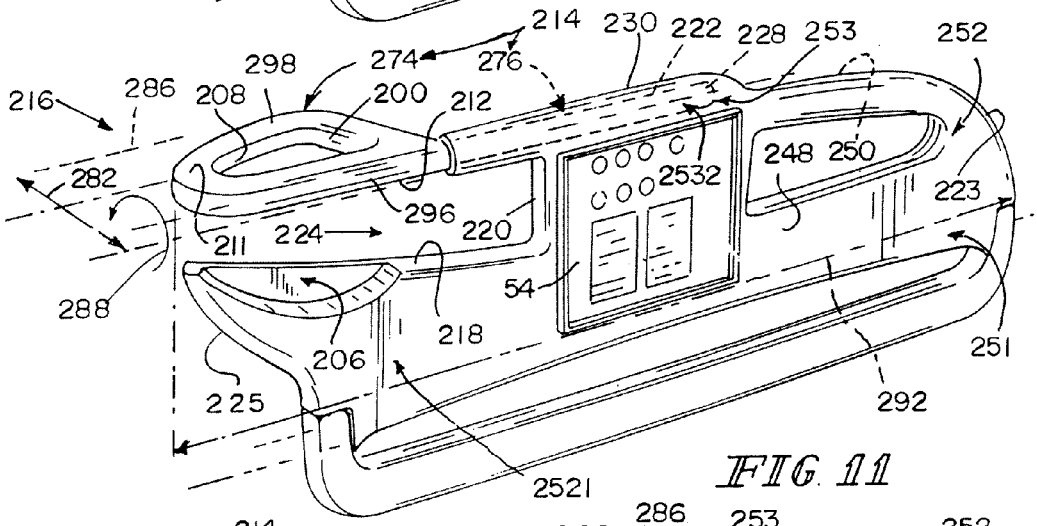
FIG. 11 is a view similar to FIG. 10 with the egress handle in a second position.
Figure 12:
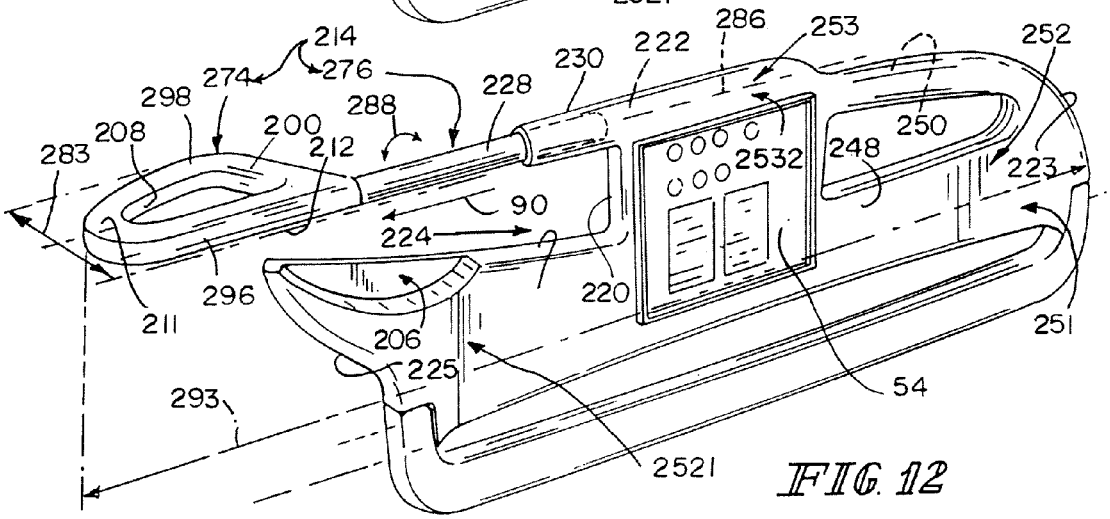
FIG. 12 is a view similar to FIG. 11 with the slide assembly in an extended position and the egress handle in a second position.

Another embodiment of a left foot siderail assembly 216 is shown in FIGS. 10-12. The left foot siderail assembly 16 is omitted from the hospital bed 210 and replaced with the left foot siderail 216. Left foot siderail 216 includes an egress unit 214 and a barrier panel 242. The egress unit 214, like the egress unit 14, is coupled the barrier panel 242 and configured to move as shown in FIGS. 11 and 12. The egress unit 214 includes a slide assembly 276 movable between a retracted position and an extended position and an egress handle 274 that is movable between a first position and a second position. When the slide assembly 276 is in the extended position and the handle 274 is in the second position, the egress unit supports a portion of a patient's weight thereon during egress of the patient from the hospital bed 210 when the hospital bed 210 is in the chair-egress position.

The barrier panel 242 includes a first portion 251, a second portion 252, and a third portion 253. The first portion 251 is also called a bottom portion 251, the second portion 252 is also called a medial portion 252, and the third portion 253 is also called a top portion 253. The top portion 253 is appended to the medial portion 252 to extend upwardly away from the medial portion 252. The barrier panel 242 also includes an outward side 248 that faces away from the mattress 22, an oppositely facing inward side 250 that faces toward the mattress 22, a foot edge 225 that faces toward the foot end 26 of the hospital bed 210, and a head edge 223 that faces toward the head end 24.

The egress unit 214 includes a handle 274 and a slide assembly 276 as shown in FIGS. 10-12. The slide assembly 276 interconnects the handle 274 to the barrier panel 242 for selective sliding movement of the handle 274 relative to the barrier panel 242. The egress unit 214 may also include an egress position controller that is used by a caregiver to retain the handle 274 in the first position of FIG. 10, the second position of FIGS. 11 and 12, or any position therebetween.

To use the egress unit 214, a caregiver may disengage an egress position controller and then move the handle 274 from the first position of FIG. 10 to the second position of FIG. 11 and move the slide assembly 276 from the retracted position of FIGS. 10 and 11 to the extended position of FIG. 12. As discussed previously, the egress-egress position controller may include a handle lock and a slide-assembly lock. The caregiver first moves the handle 274 about a handle-pivot axis 286 in a counter-clockwise direction 288 from a first position to a second position in which the handle 274 extends away from the inward side 250 of the barrier panel 242 toward the mattress 22 as shown in FIG. 11. Next, the caregiver slides the handle 274 away from the barrier panel 242 toward the foot end 26 of the hospital bed 210 to cause the slide assembly 276 to assume the extended position as shown in FIG. 12.

The slide assembly 276, when in the retracted position, causes the handle 274 to be adjacent to the top portion 253 of the barrier panel 242. As illustrated in FIG. 10, the handle 274 lies between the head end 223 and the foot end 225 of the barrier panel 242. The handle 274 also lies in coplanar relation with the barrier panel 242 and does not interfere with the movement of the siderail 216 between the raised and the lowered positions. For example, the slide assembly 276 may be in the retracted position when the hospital bed 210 is in bed position or the chair-egress position.

The handle 274 is movable about the handle-pivot axis 286 between the first position and the second position whether the slide assembly 276 is in the retracted position or the extended position. The handle 274, when in the first position, extends downwardly toward the ground 99 and lies in a recess 206 that is formed in the outward side 248 of the barrier panel 242. When the slide assembly 276 is in the retracted position and the handle 274 is in the first position, the handle 274 cooperates with the barrier panel 242 to define a first barrier width 281 and a first barrier length 291 as shown in FIG. 10.

The handle 274 moves from the first position to the second position by rotating about the handle-pivot axis 286 in the counter-clockwise direction 288 about 270 degrees as shown in FIG. 12. Both handles of left and right siderails 16, 18 extend toward one another to minimize a distance between the foot siderails 16, 18. The minimized distance between the foot siderails allows a patient to grip the handles 274 to support a portion of the patient's weight during egress from the hospital bed 210. When the handle 274 is in the second position and the slide assembly 276 is in the retracted position, the handle 274 cooperates with the barrier panel 242 to define a second barrier width 282 and a second barrier length 292. The second barrier width 282 is relatively larger than the first barrier width and the second barrier length 292 is about equal to the first barrier length 291.

The slide assembly 276 finally moves from the retracted position to the extended position by translating the handle 274 away from the barrier panel 242 as shown in FIG. 12. The slide assembly 276, when in the extended position, causes the handle 274 to be spaced-apart from the barrier panel 242 in the longitudinal direction 90. The slide assembly 276 is configured to support the handle 274 as it slides along the handle-pivot axis 286 between the extended and retracted positions. The extended position of the slide assembly 276 may be an intermediary position of the handle 274. Similarly, the extended position of the slide assembly 276 also provides means for extending a length of the barrier panel to minimize a gap 94 formed between the foot panel 34 and the foot edge 225 of the barrier panel 242. When the handle 274 is in the second position, and the slide assembly 276 is in the extended position, the handle 274 cooperates with the barrier panel 242 to define a third barrier width 283 and a third barrier length 293. The third barrier width 283 is about equal to the second barrier width 282 and the third barrier length 293 is greater than the first and second barrier lengths 291, 292.

As shown in FIG. 10, the handle 274 includes a first side 211, an oppositely facing second side 212, a handle mount 296, a forward grip 298, and a lateral grip 200. The handle mount 296 interconnects the forward grip 298 and the lateral grip 200 to the slide assembly 276 as shown in FIG. 12. The lateral grip 200 is coupled to the handle mount 296 and extends away from the handle mount 296 at an angle to interconnect to the forward grip 298 to the handle mount 296. The forward grip 298 is coupled to the lateral grip 200 and is arranged to extend to the handle mount 296 as shown in FIG. 10. The handle mount 296, the forward grip 298, and the lateral grip 200 cooperate together to define a first aperture 208 that is configured to receive a patient's hand therein during use of the handle 274.

The first side 211 of the handle 274, when the handle 274 is in the first position, is aligned with the outward side 248 of the barrier panel 242 and the second side 212 of the handle 274 faces into the recess 206 formed in the outward side 248 of the barrier panel 242. A second aperture 209 is formed by the handle mount 296, a top side 218 included in a foot section 2521 of the medial portion 252, and a foot surface 220 included in a middle section 2532 included in the top portion 253 when the slide assembly 276 is in the retracted position and the handle 274 is in the first position.

The first and second sides 211, 212 of the handle 274 lie perpendicular to the outward and inward sides 248, 250 of the barrier panel 242 when the handle 274 is in the second position. The lateral grip 200 extends away from the handle mount 296 in the lateral direction 90. The forward grip 298 is cantilevered above the mattress 22 as suggested in FIG. 12. When the slide assembly 276 is in the extended position and the handle 274 is in the second position, the second aperture 209 is transformed into a U-shaped slot 224 that opens toward the foot end 26 of the hospital bed 210.

The handle mount 296 of the handle 274 includes a first end near the foot end 26 of the hospital bed 210 and an opposite second end near the head end 24 as suggested in FIGS. 10-12. The first end is coupled to the forward grip 298 and the second end is coupled to the lateral grip 200 to cause the handle mount 296 to extend therebetween. The second end of the handle mount 296 is also coupled to the slide assembly 276. As shown in FIGS. 10-12, the handle mount 296 defines the handle-pivot axis 286 which is generally horizontal and parallel to the longitudinal axis of the hospital bed 210.

As discussed previously, the slide assembly 276 is configured to support the handle 274 for sliding movement back and forth relative to the barrier panel 242. The slide assembly 276, unlike the slide assembly 76, includes only one slide-tube receiver 222 and one associated slide tube 228 as shown in FIG. 13. The slide-tube receiver 222 is coupled to the top portion 253 of the barrier panel 242 to move therewith. The slide tube 228 is coupled to the slide-tube receiver 222 for sliding movement back and forth in the longitudinal direction 90. The slide-tube receiver 222 lies adjacent to a top side 230 of the top portion 253 of the barrier panel 242.

The slide-tube receiver 222 of FIGS. 10 and 11, includes a space formed in the barrier panel 242 and a bearing aperture formed in a foot surface 220 included in the middle section 2532 of the top portion 253. The bearing aperture opens into the space and is configured to support the slide tube 228 for sliding movement therein. The slide tube 228 is configured to have sufficient strength to support a portion of the patient's weight when the slide assemblies 276 are in the extended positions and the patient is using the handles 274 to egress from the hospital bed 210.

In some embodiments, the foot siderail may further include an alert light that is coupled electrically to the bed controller 58 to provide light when called upon by the bed controller 58. The alert light may be coupled to the barrier panel to shine light on the egress unit. The bed controller may activate the alert light when the hospital bed is in the chair-egress position to alert a patient or caregiver that the handle is available for use. Thus, the alert light may provide a reminder to users and helps patients use the handle included in the egress unit when ambient room light is low.

In some embodiments, the egress unit may include a user interface that is mounted to the handle and coupled electrically to the bed controller 58. The bed controller 58 is coupled electrically to the elevation system 32 to control movement of the upper frame 30 relative to the base 28 in response to inputs received from any of the user interfaces. A patient may use the user interface to move the hospital bed 10 from the chair-egress position to the bed position. The patient may also cause the hospital bed 10 to move from the chair-egress position to an egress-lift position in which the deck 64 is arranged in the chair-egress position, but the elevation system 32 tilts the upper frame 30 and the deck 64 upwardly to aid the patient during egress from the hospital bed 10.

Illustrative bed 10 is a so-called chair egress bed, in that it is movable between a bed position, as shown in FIG. 1, and a chair-egress position as shown in FIG. 2. However the teachings of this disclosure are applicable to all types of hospital beds, including those that are incapable of achieving a chair-egress position. Some hospital beds are only able to move into a chair-like position, sometimes referred to by those in the art as a "cardiac chair position," and this disclosure is equally applicable to those types of beds. Furthermore, the teachings of this disclosure are applicable to other types of patient support apparatuses such as stretchers, motorized chairs, operating room (OR) tables, specialty surgical tables such as orthopedic surgery tables, examination tables, and the like.

Although certain illustrative embodiments have been described in detail above, variations and modifications exist within the scope and spirit of this disclosure as described and as defined in the following claims.

The invention claimed is:

1. A siderail assembly for a patient support apparatus, the siderail assembly comprising a barrier adapted for mounting to a frame of a patient support apparatus to pivot between a raised position and a lowered position, the barrier including an outward side adapted to face away from a patient support apparatus and an inward side adapted to face toward a deck included in a patient support apparatus and an egress unit coupled to the barrier to move relative to the barrier between a barrier position in which the egress unit lies in a generally vertical plane adjacent to the barrier and an egress position in which a portion of the egress unit lies spaced-apart from and extends away from the inward side of the barrier and lies in a plane that is not generally parallel with the generally vertical plane.

2. The siderail assembly of claim 1, wherein the egress unit includes a handle and a slide assembly, the slide assembly lies between and interconnects the handle and the barrier, the slide assembly is movable between a retracted position in which the handle is adjacent to the barrier and an extended position in which the handle has translated away from the barrier in a longitudinal direction.

3. The siderail assembly of claim 2, wherein the handle and the barrier cooperate to define a first barrier length when the slide assembly is in the retracted position, a second barrier length when the slide assembly is in the extended position, and the first barrier length is less than the second barrier length.

4. The siderail assembly of claim 3, wherein the handle is coupled to the slide assembly to move about a pivot axis between a first position in which the handle is arranged to lie in a recess formed in the barrier and a second position in which the handle extends away from the inner side of the barrier and lies in a generally horizontal plane, the horizontal plane being generally orthogonal to both the inner and outer sides of the barrier.

5. The siderail assembly of claim 4, wherein the handle includes a forward grip, a lateral grip, and a grip mount, the grip mount interconnecting the forward grip and the lateral grip to the slide assembly, and the grip mount defines the pivot axis.

6. The siderail assembly of claim 4, wherein the barrier pivots about a generally horizontal axis between the raised and the lowered positions.

7. The siderail assembly of claim 6, wherein the pivot axis is spaced-apart above and generally parallel to the generally horizontal axis.

8. The siderail assembly of claim 2, wherein the handle is coupled to the slide assembly to move about a pivot axis between a first position in which the handle extends away from the slide assembly in a longitudinal direction and lies in a generally vertical first plane and a second position in which the handle extends away from the slide assembly in a lateral direction and lies in a generally vertical second plane, the lateral direction being orthogonal to the longitudinal direction and the second plane being orthogonal to the first plane.

9. The siderail assembly of claim 8, wherein the barrier pivots about a generally horizontal axis between the raised and the lowered positions.

10. The siderail assembly of claim 9, wherein the pivot axis intersects the generally horizontal axis at about a right angle.

11. The siderail assembly of claim 2, wherein the egress unit further comprises an egress position controller configured to selectively block movement of the egress unit between the barrier position and the egress position.

12. The siderail assembly of claim 11, wherein the egress position controller includes a handle lock coupled to the slide assembly to move therewith and is configured to selectively block movement of the handle relative to the slide assembly and a slide lock coupled to the barrier to selectively block movement of the handle relative to the barrier.

13. The siderail assembly of claim 12, wherein the handle lock includes a plunger coupled to the slide assembly to move relative to the slide assembly, a receiver formed in the handle and configured to mate with the plunger when the handle lock is in a locked position, and a bias spring interconnecting the plunger and the slide assembly and configured to provide a bias force to the plunger to urge the plunger to mate with the receiver.

14. The siderail assembly of claim 13, wherein the slide lock includes a piston coupled to the barrier to move relative to the barrier, a notch formed in the slide assembly and configured to mate with the piston when the slide lock is in a locked position, and a bias spring interconnecting the piston and the barrier, the bias spring being configured to provide a bias force to the piston to urge the piston to mate with the notch.

15. A siderail assembly for a patient support apparatus, the siderail assembly comprising a barrier movable between a raised position and a lowered position, the barrier including a foot edge facing toward a foot end of the patient support apparatus, a spaced-apart head edge facing toward a head end of the patient support apparatus, an inner side facing toward a mattress included in the patient support apparatus, an oppositely facing outer side facing away from the mattress, a first portion adapted to couple to a side of the patient support apparatus to extend between the head and the foot edges, a second portion appended to the first portion to extend in an upward direction and between the head and foot edges, and a third portion appended to the second portion to extend in the upward direction away from the second portion and an egress unit including a handle and a slide assembly arranged to lie between and interconnect the handle and the barrier for movement of the slide assembly between a retracted position in which the handle lies in confronting relation with the barrier and an extended position in which the handle is spaced-apart from the barrier and the handle is movable between a first position in which the handle extends away from the mattress and a second position in which the handle extends away from the inner side of the barrier toward the mattress.

16. The siderail assembly of claim 15, wherein the slide assembly is spaced-apart above the first portion of the barrier and coupled to the third portion.

17. The siderail assembly of claim 16, wherein the slide assembly includes a first slide tube and a first slide-tube receiver coupled to the top portion of the barrier to move therewith and the first slide tube is coupled to the first slide-tube receiver for translating movement back and forth relative to the slide-tube receiver.

18. The siderail assembly of claim 17, wherein the first slide tube is generally aligned with the pivot axis to move back and forth along the pivot axis.

19. The siderail assembly of claim 17, wherein the slide assembly further comprises a second slide tube and a second slide-tube receiver, the second slide tube is spaced-apart below the first slide tube, the second slide-tube receiver is coupled to the second portion of the barrier to move therewith, and the second slide-tube receiver is spaced-apart below the first slide-tube receiver.

20. The siderail assembly of claim 15, further comprising a linkage that includes a guide adapted for mounting to the side of the patient support apparatus and a support coupled to the guide and to the barrier to cause the guide to move with the barrier as the barrier moves between the raised and the lowered positions.

21. A siderail assembly for a patient support apparatus, the siderail assembly comprising, a barrier adapted for mounting to a frame of a patient support apparatus to move between a raised position and lowered position while the barrier remains in a substantially vertical orientation, the barrier including a foot edge, a spaced-apart head edge, an inner side, an oppositely facing outer side, a first portion adapted to couple to a frame of the patient support apparatus to extend between the head and the foot edges, a second portion appended to the first portion to extend in an upward direction and extend between the head and foot edges, and a third portion appended to the second portion to extend in the upward direction away from the second portion to locate the second portion between the first and third portions, and an egress unit including a handle and a slide assembly interconnecting the handle to the barrier, the slide assembly being movable from a retracted position in which the handle is in confronting relation with the barrier to an extended position in which the handle has slid in a longitudinal direction away from the barrier, and the handle being movable about a pivot axis from a first position in which the handle is in a generally vertical plane, the generally vertical plane being parallel to the outer and inner sides of the barrier, to a second position in which the handle lies in a plane, the plane being generally orthogonal to the inner and outer sides of the barrier.

22. The siderail assembly of claim 21, wherein the siderail assembly further includes a light coupled to the barrier, the light being configured to provide light to the handle in response to a command from a bed controller.

23. The siderail assembly of claim 21, wherein the siderail assembly further comprises a sensor configured to sense a position of the handle relative to the barrier and the sensor is adapted to send an input to a bed controller to control movement of the patient support apparatus in response to the second input.

24. The siderail assembly of claim 21, wherein the handle is movable in a counter clockwise direction about the pivot axis from the first position to the second position.

* * * * *